US011051602B2

(12) United States Patent
Ham et al.

(10) Patent No.: US 11,051,602 B2
(45) Date of Patent: Jul. 6, 2021

(54) POWDER DISCHARGING CONTAINER

(71) Applicant: YONWOO CO., LTD., Incheon (KR)

(72) Inventors: Ki Young Ham, Incheon (KR); Seo Hui Jung, Incheon (KR)

(73) Assignee: YONWOO CO., LTD., Incheon (KR)

( * ) Notice: Subject to any disclaimer, the term of this patent is extended or adjusted under 35 U.S.C. 154(b) by 0 days.

(21) Appl. No.: 17/250,137

(22) PCT Filed: Apr. 3, 2019

(86) PCT No.: PCT/KR2019/003943
§ 371 (c)(1),
(2) Date: Dec. 4, 2020

(87) PCT Pub. No.: WO2019/245138
PCT Pub. Date: Dec. 26, 2019

(65) Prior Publication Data

US 2021/0161273 A1 Jun. 3, 2021

(30) Foreign Application Priority Data

Jun. 20, 2018 (KR) ..... 10-2018-0070961

(51) Int. Cl.
*A45D 33/02* (2006.01)
*B05B 11/00* (2006.01)

(52) U.S. Cl.
CPC ..... *A45D 33/025* (2013.01); *B05B 11/3023* (2013.01); *B05B 11/3047* (2013.01); *B05B 11/3069* (2013.01)

(58) Field of Classification Search
CPC ..... A45D 33/025; B05B 11/3023; B05B 11/3069; B05B 11/3047
See application file for complete search history.

(56) References Cited

U.S. PATENT DOCUMENTS 5,100,027 A * 3/1992 Gueret ..... A45D 34/04 222/105
2005/0167450 A1* 8/2005 Lanzendorfer ..... A61K 8/26 222/257

(Continued)

FOREIGN PATENT DOCUMENTS

KR 10-1200186 B1 11/2012
KR 10-1248363 B1 4/2013

(Continued)

*Primary Examiner* — Donnell A Long
(74) *Attorney, Agent, or Firm* — Novick, Kim & Lee, PLLC; Sang Ho Lee; Hyun Woo Shin

(57) ABSTRACT

Provided is a powder discharging container. The powder discharging container includes a container main body in which powder is stored, a button part which is disposed at an upper side of the container main body to be pressed by a user and which has a discharge hole formed at one side, a stem which is configured to ascend or descend according to whether the button part is pressed and which has a movement hole formed inside an upper portion to communicate with the discharge hole, a path forming part which is disposed inside the stem, communicates with the inside of the container main body, and has a powder movement path in which the powder moves and an air movement path in which air moves formed therein, and a compression chamber part which is coupled to lower portions of the stem and the path forming part, has a chamber formed therein to store air, and is configured to, as the button part is pressed, inject the air inside the chamber into the movement hole through the air movement path, wherein, as the air is injected from the chamber into the movement hole due to the button part being pressed, the powder inside the container main body moves through the powder movement path and the movement hole and is discharged to the outside through the discharge hole.

11 Claims, 10 Drawing Sheets

(56) References Cited

U.S. PATENT DOCUMENTS

| | | | | |
|---|---|---|---|---|
| 2018/0178232 | A1* | 6/2018 | Jung | A45D 33/02 |
| 2019/0022679 | A1* | 1/2019 | Goutayer | B05B 11/00416 |
| 2019/0255548 | A1* | 8/2019 | Moignard | B05B 11/0054 |
| 2020/0054114 | A1* | 2/2020 | Kang | A45D 33/26 |

FOREIGN PATENT DOCUMENTS

| | | | |
|---|---|---|---|
| KR | 10-1378719 | B1 | 3/2014 |
| KR | 10-1454255 | B1 | 11/2014 |
| KR | 10-1590865 | B1 | 2/2016 |
| KR | 10-1717972 | B1 | 3/2017 |

* cited by examiner

POWDER DISCHARGING CONTAINER

TECHNICAL FIELD

The present invention relates to a powder discharging container, and more particularly, to a powder discharging container capable of discharging powder, which is stored inside a container main body, in constant amounts by using a method in which a fixed volume of air stored in a chamber is compressed by a piston and discharged to the outside through an air movement path.

BACKGROUND ART

Generally, powder has a good feeling of use when applied to the skin, has high water repellency, thus making it possible to feel fresh during makeup, and enables natural makeup. Therefore, many women use powder while applying makeup.

A container for discharging powder has been disclosed in Korean Patent Registration No. 10-1378719 (hereinafter referred to as "Patent Document 1").

Referring to Patent Document 1, the container for discharging powder includes a container main body in which the powder is stored, a button part which is disposed at an upper portion of the container main body to ascend or descend according to whether a user presses the button part and which has a discharge hole formed at one side to discharge the powder, and a stem which is coupled to a lower portion of the button part to move along with movement of the button part and which has a powder movement path in which the powder moves and an air movement path in which air moves separately formed therein, wherein, as the button part is pressed, a pressure inside the container main body is changed, the powder and air move into the stem through the powder movement path and the air movement path, respectively, and the powder is injected through the discharge hole due to an air pressure.

The conventional container for discharging powder according to Patent Document 1 is configured so that, when the button part is pressed, the pressure inside the container main body is changed due to a piston coupled to a lower portion of the stem, the air and powder move through the air movement path and the powder movement path which are separately formed inside the stem, and the powder is discharged. However, since the volume of air ejected through the air movement path is not fixed according to the volume of remaining powder or the like, it is difficult to discharge the powder in constant amounts, and there is a problem of causing an inconvenience in use.

Therefore, there is a need for a container capable of addressing the above-mentioned problems.

DISCLOSURE

Technical Problem

The present invention is directed to providing a powder discharging container capable of discharging powder, which is stored inside a container main body, in constant amounts by using a method in which a fixed volume of air stored in a chamber is compressed by a piston and discharged to the outside through an air movement path The technical objectives of the present invention are not limited to the above-mentioned objective, and other unmentioned objectives may become apparent to those of ordinary skill in the art from the following description.

Technical Solution

An embodiment of the present invention provides a powder discharging container. The powder discharging container includes a container main body in which powder is stored, a button part which is disposed at an upper side of the container main body to be pressed by a user and which has a discharge hole formed at one side, a stem which is configured to ascend or descend according to whether the button part is pressed and which has a movement hole formed inside an upper portion to communicate with the discharge hole, a path forming part which is disposed inside the stem, communicates with the inside of the container main body, and has a powder movement path in which the powder moves and an air movement path in which air moves formed therein, and a compression chamber part which is coupled to lower portions of the stem and the path forming part, has a chamber formed therein to store air, and is configured to, as the button part is pressed, inject the air inside the chamber into the movement hole through the air movement path, wherein, as the air is injected from the chamber into the movement hole due to the button part being pressed, the powder inside the container main body moves through the powder movement path and the movement hole and is discharged to the outside through the discharge hole.

The compression chamber part may include an upper housing which is coupled to an upper portion of the container main body and into which the stem and the path forming part are inserted, a lower housing which is coupled to a lower portion of the upper housing and forms the chamber in which the air is stored, a piston which is coupled to a lower portion of the stem and, according to whether the button part is pressed, ascends or descends in close contact with an inner side surface of the lower housing to change a pressure of the air inside the chamber and move the air inside the chamber to the air movement path, and a nozzle part which is disposed inside the lower housing, passes through the piston to be coupled to a lower portion of the path forming part, and is configured to allow the powder movement path to communicate with the inside of the container main body.

An accommodation hole into which the lower portion of the stem is inserted may be formed to pass through the piston, the nozzle part may pass through the piston via the accommodation hole and be coupled to the lower portion of the path forming part, and the air inside the chamber may move to the air movement path through a separation space between an inner circumferential surface of the accommodation hole and the nozzle part.

The compression chamber part may further include a first check valve which is coupled to an inner side of the accommodation hole and configured to regulate an inflow of air from the air movement path to the chamber through the separation space.

The first check valve may include a first coupling part coupled to the inner side of the accommodation hole, and a first sealing part which extends from the first coupling part toward an outer circumferential surface of the nozzle part, and the first sealing part may come in close contact with the outer circumferential surface of the nozzle part and block the inflow of air from the air movement path to the chamber, but when the piston descends, the first sealing part may be spaced apart from the outer circumferential surface of the nozzle part due to an air pressure and allow the chamber and the air movement path to communicate.

At least a portion of the first sealing part may be formed to be inclined upward toward the air movement path.

A stepped part which protrudes toward the inner side of the accommodation hole may be formed in the piston, and the first coupling part of the first check valve may be seated on the stepped part and pressed by the lower portion of the stem that is inserted into the accommodation hole.

At least one air inlet hole configured to allow the chamber to communicate with the inside of the container main body may be formed in an inner lower end surface of the lower housing, and the compression chamber part may further include a second check valve configured to regulate movement of the air from the chamber into the container main body through the air inlet hole.

The second check valve may include a second coupling part coupled to the inner lower end surface of the lower housing, and a second sealing part formed to extend outward from one end of the second coupling part, and the second sealing part may come in close contact with the inner lower end surface of the lower housing in which the air inlet hole is formed and block the movement of air from the chamber into the container main body through the air inlet hole, but when the piston ascends, the second sealing part may be spaced apart from the inner lower end surface of the lower housing due to a pressure of air flowing into the container main body through the powder movement path and may allow the chamber to communicate with the inside of the container main body.

An extension which extends a predetermined length downward and in which the nozzle part ascends or descends according to whether the button part is pressed may be formed at a lower portion of the lower housing.

The powder discharging container may further include a tube which has one end coupled to the extension and the other end extending from a lower end surface of the container main body to a predetermined position and which is configured to allow the nozzle part to communicate with the inside of the container main body, wherein at least a portion of an outer circumferential surface of the other end of the tube is cut out upward so that a powder inlet is formed.

Advantageous Effects

According to the present invention, since a chamber configured to store a fixed amount of air is formed, and the fixed amount of air stored in the chamber is compressed by a piston and discharged to the outside through an air movement path, it is possible to suction powder in constant amounts to a powder movement path and discharge the powder in constant amounts regardless of the amount of powder stored inside a container main body.

DESCRIPTION OF DRAWINGS

Brief description of each drawing will be provided for better understanding of the drawings referenced in the detailed description of the present invention.

MODES OF THE INVENTION

Figure 1:
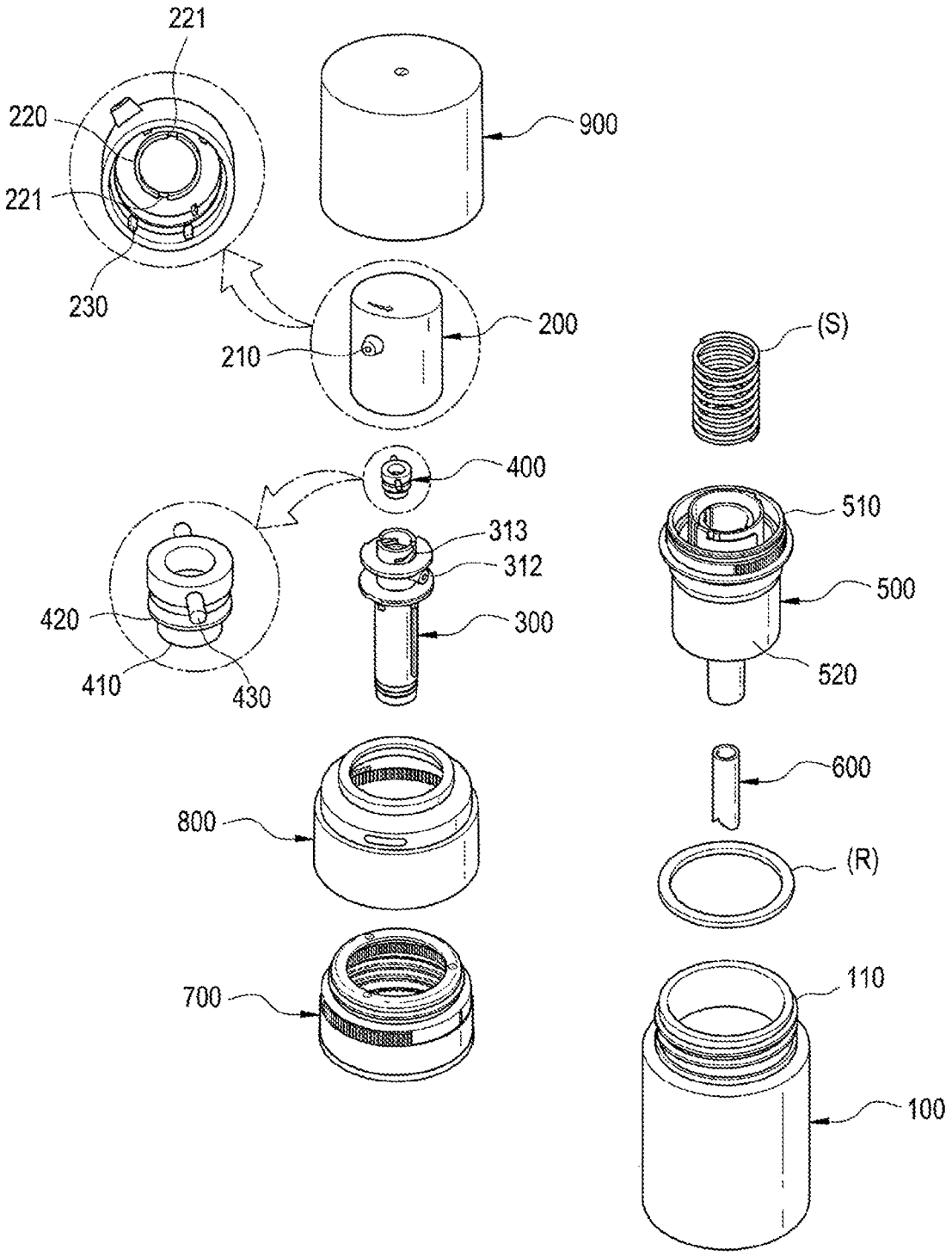
FIG. 1 illustrates an exploded perspective view of a powder discharging container according to an embodiment of the present invention.

Hereinafter, embodiments according to the present invention will be described with reference to the accompanying drawings. In assigning reference numerals to elements of each drawing, it should be noted that the same reference numerals are assigned to the same elements as much as possible even when the elements are illustrated in different drawings. Also, in describing the embodiments of the present invention, when detailed description of a related known configuration or function is determined as interfering with the understanding of the embodiments of the present invention, the detailed description thereof will be omitted. In addition, although the embodiments of the present invention will be described below, the technical idea of the present invention is not limited thereto, and the embodiments may be modified and embodied in various other ways by those of ordinary skill in the art. Meanwhile, for convenience of the following description, vertical and horizontal directions are based on the drawings, and the scope of the present invention is not necessarily limited to the corresponding directions.

Throughout the specification, when a certain part is described as being "connected" to another part, this includes a case in which the certain part is "indirectly connected" to the other part while another element is present therebetween as well as a case in which the certain part is "directly connected" to the other part. Throughout the specification, when a certain part is described as "including" a certain element, this signifies that the certain part may further include another element rather than excluding the other element unless particularly described otherwise. Also, in describing elements of the embodiments of the present invention, terms such as first, second, A, B, (a), and (b) may be used. The terms are only intended to distinguish one element from another element, and the essence, order, sequence, or the like of the corresponding element is not limited by the terms.

Figure 2:
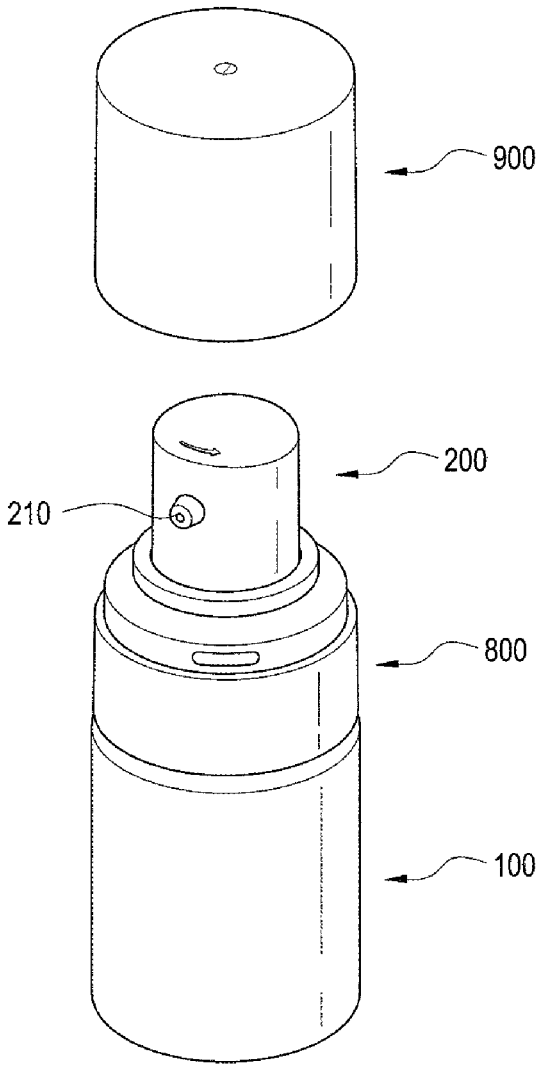
FIG. 2 illustrates a combined perspective view of the powder discharging container according to an embodiment of the present invention.
Figure 3:
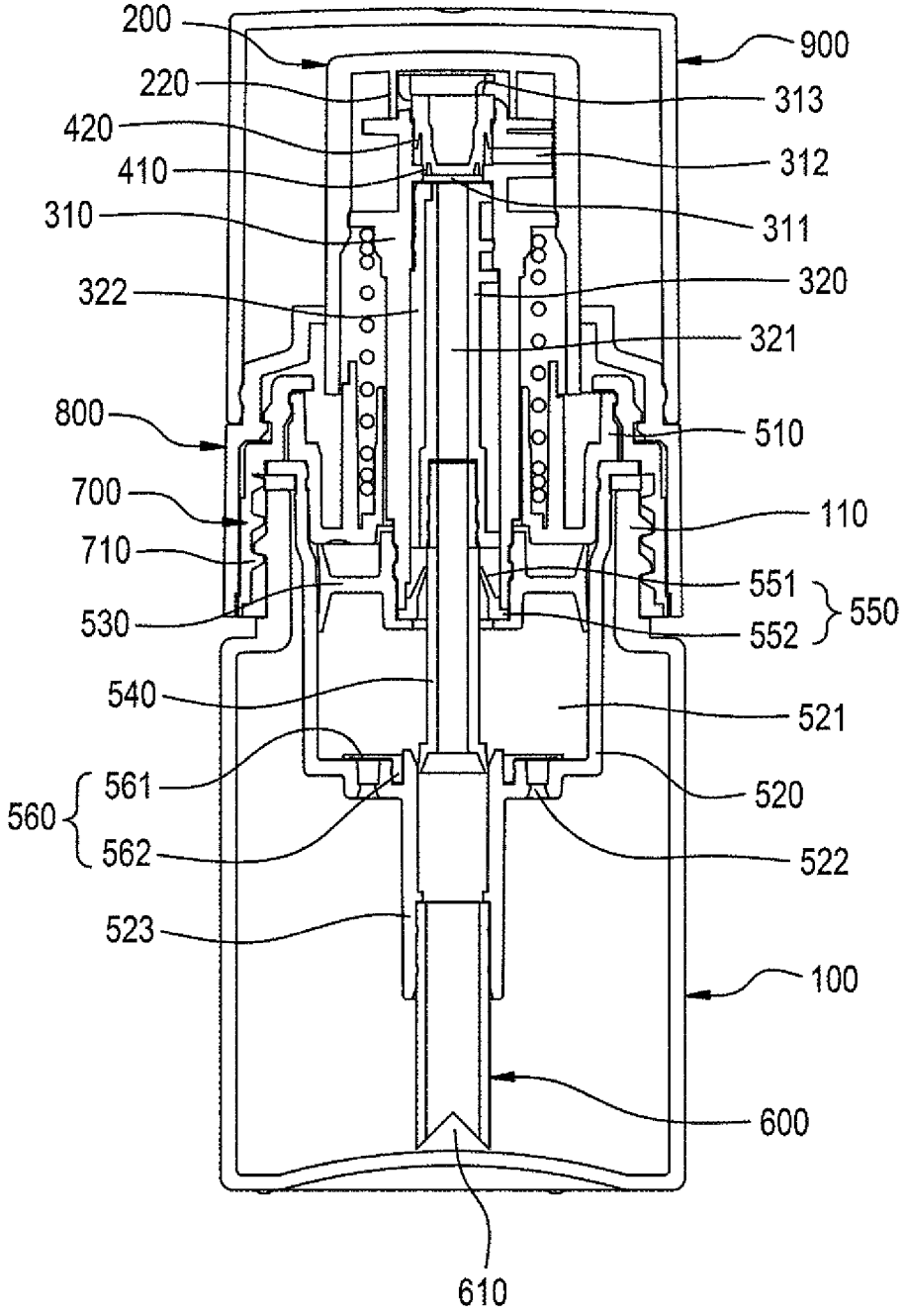
FIG. 3 illustrates a cross-sectional view of the powder discharging container according to an embodiment of the present invention.
Figure 4:
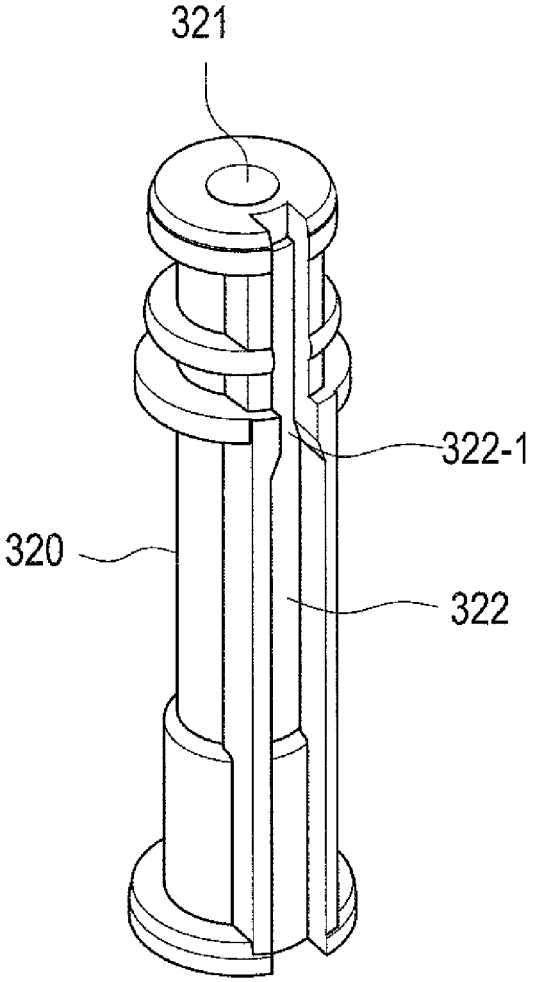
FIG. 4 illustrates a path forming part of the powder discharging container according to an embodiment of the present invention.
Figure 5:
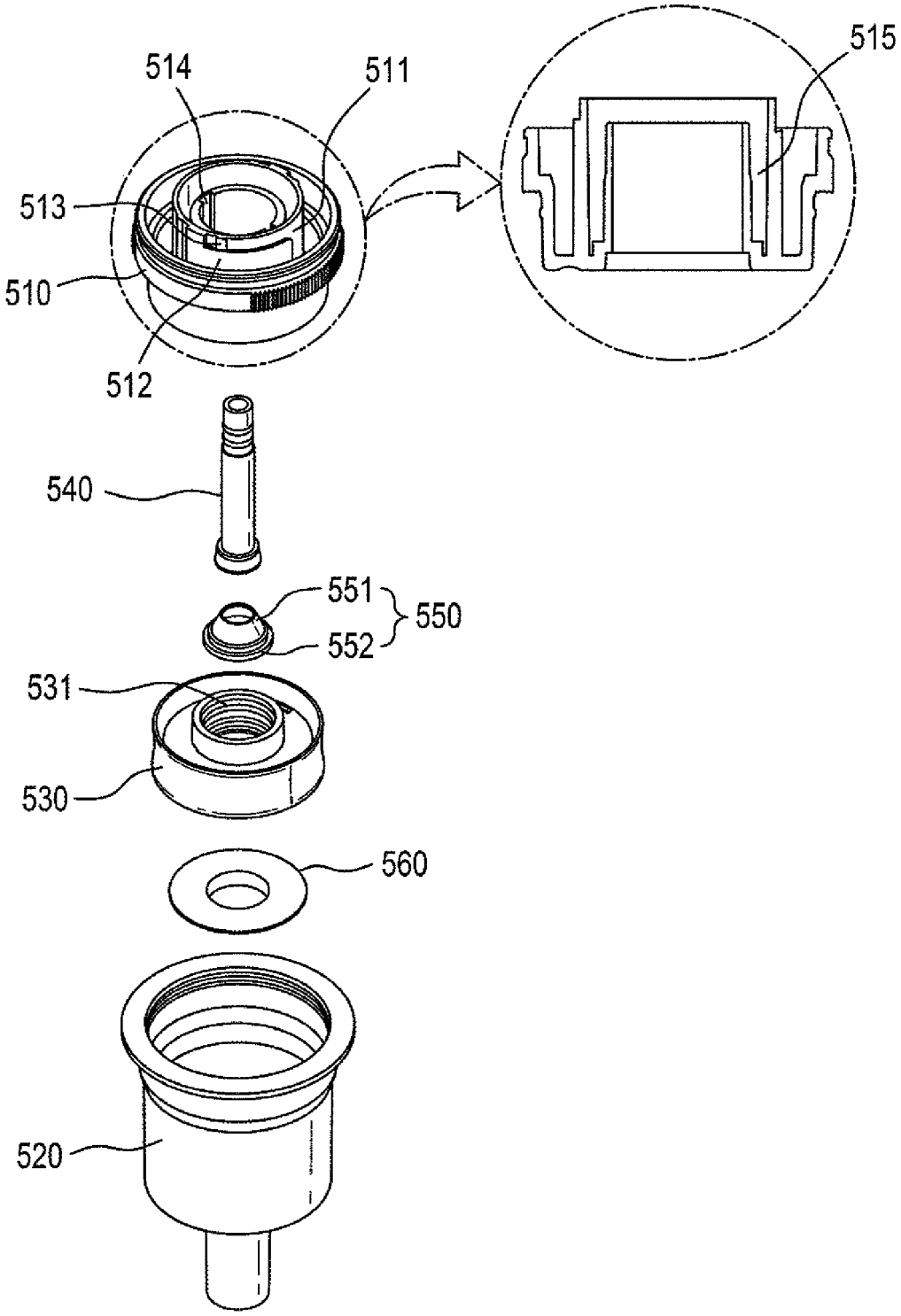
FIG. 5 illustrates a compression chamber part of the powder discharging container according to an embodiment of the present invention.

FIG. 1 illustrates an exploded perspective view of a powder discharging container according to an embodiment of the present invention, FIG. 2 illustrates a combined perspective view of the powder discharging container according to an embodiment of the present invention, FIG. 3 illustrates a cross-sectional view of the powder discharging container according to an embodiment of the present invention, FIG. 4 illustrates a path forming part of the powder discharging container according to an embodiment of the present invention, and FIG. 5 illustrates a compression chamber part of the powder discharging container according to an embodiment of the present invention.

Figure 6:
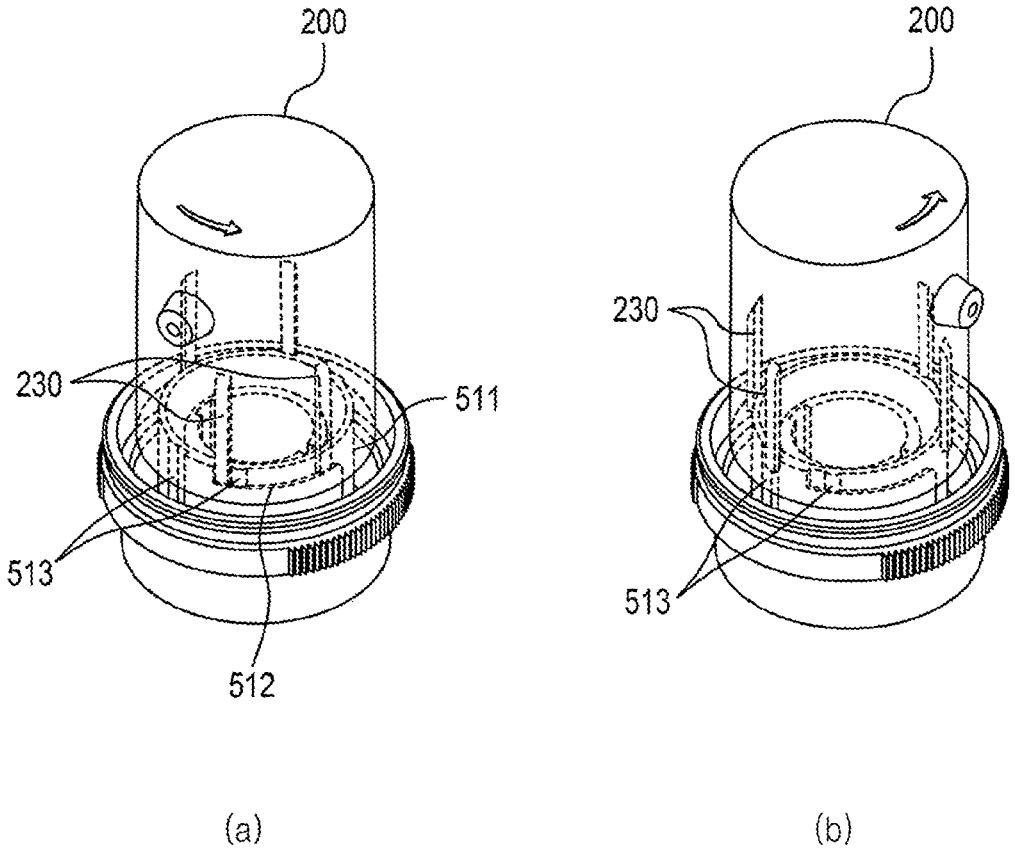
FIG. 6 illustrates a coupling relationship between a button part and an upper housing of the powder discharging container according to an embodiment of the present invention.
Figure 7:
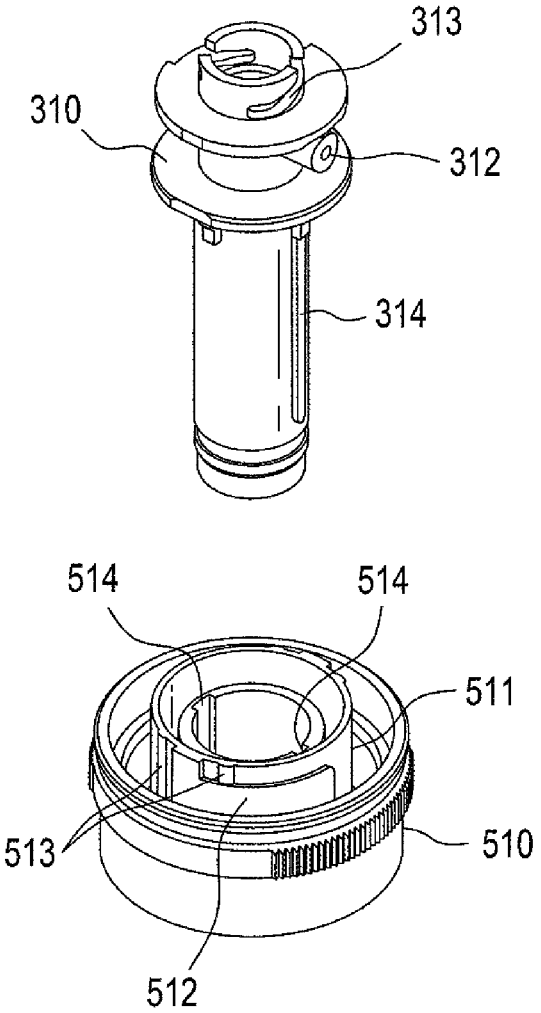
FIG. 7 illustrates a coupling relationship between the path forming part and the upper housing of the powder discharging container according to an embodiment of the present invention.

Also, FIG. 6 illustrates a coupling relationship between a button part and an upper housing of the powder discharging container according to an embodiment of the present invention, and FIG. 7 illustrates a coupling relationship between the path forming part and the upper housing of the powder discharging container according to an embodiment of the present invention.

Referring to FIGS. 1 to 7, the powder discharging container may include a container main body 100, a button part 200, a movement part 300, an opening/closing member 400, a compression chamber part 500, a tube 600, a screw cap 700, a shoulder part 800, and an over-cap 900.

The container main body 100 stores powder therein, and an outlet 110 may be formed at an upper portion of the container main body 100 to allow the powder stored therein to be discharged. The compression chamber part 500 may be inserted into the container main body 100 through the outlet 110 of the container main body 100 and may be coupled thereto to close an upper end of the outlet 110. In an embodiment, a gasket R may be disposed at the upper end of the outlet 110 to allow coupling of the compression chamber part 500.

The button part 200 is coupled to an upper portion of the container main body 100 so as to be rotatable with respect to the movement part 300 (particularly, a stem 310), ascends or descends according to whether a user presses the button part 200, and delivers a pressure to the stem 310 and the compression chamber part 500. A discharge hole 210 through which the powder is discharged may be formed at one side of the button part 200.

Also, a guide tube 220 configured to guide ascending and descending of the opening/closing member 400 may be disposed at an upper side inside the button part 200. A vertical guide groove 221 into which an ascending protrusion 430 of the opening/closing member 400 is inserted may be formed at both sides of the guide tube 220 to guide vertical movement of the opening/closing member 400.

Also, a guide protrusion 230 configured to limit and/or guide ascending/descending movement of the button part 200 may be disposed on an inner circumferential surface of the button part 200. Under a normal storage state, the guide protrusion 230 may be disposed above a descent preventing step 512 formed in an upper housing 510 of the compression chamber part 500 and prevent the button part 200 from descending, and when the button part 200 is rotated in a first direction for use, the guide protrusion 230 may be disposed above a guide groove 511 formed in the upper housing 510 and move along the guide groove 511 to allow ascending and descending of the button part 200.

The movement part 300 delivers a pressure due to the user pressing the button part 200 to the compression chamber part 500 and delivers air stored in the compression chamber part 500 and the powder stored in the container main body 100 to the outside. The movement part 300 may include the stem 310 and a path forming part 320.

The stem 310 may be coupled to a lower portion of the button part 200 and ascend or descend along with the button part 200. Here, a movement hole 311 may be formed at an upper portion inside the stem 310 to allow the powder to move in a direction toward the discharge hole 210 due to manipulation of the button part 200, and a communication hole 312 which communicates with the discharge hole 210 may be formed at one side of the stem 310 so that the powder moving through the movement hole 311 is discharged through the discharge hole 210.

Also, a spiral guide groove 313 may be formed at both sides of an outer circumferential surface of an upper end portion of the stem 310 to guide ascending and descending of the opening/closing member 400. When the button part 200 rotates in the first direction or a second direction opposite thereto, the ascending protrusion 430 of the opening/closing member 400 moves along the spiral guide groove 313 so that the ascending and descending of the opening/closing member 400 occur.

Also, a rotation preventing protrusion 314 configured to prevent the stem 310 from rotating along with the button part 200 may be formed on the outer circumferential surface of the stem 310. Since the rotation preventing protrusion 314 is inserted into a rotation preventing groove 514 formed in the upper housing 510 of the compression chamber part 500, during rotation of the button part 200 for ascending or descending of the opening/closing member 400, the stem 310 is prevented from rotating along with the button part 200.

Also, a spring S may be disposed between an upper portion of the stem 310 and the upper housing 510 of the compression chamber part 500 to surround the outer circumferential surface of the stem 310. The spring S provides an elastic force in an upward direction with respect to the stem 310 so that the button part 200 may be restored to its original position when the user releases the pressure on the button part 200.

Also, a piston 530 of the compression chamber part 500 may be coupled to a lower portion of the stem 310. As will be described below, the piston 530 may ascend or descend inside a chamber 521 of the compression chamber part 500 according to whether the button part 200 is pressed and may change an air pressure of the chamber 521.

The path forming part 320 is disposed inside the stem 310, and a powder movement path 321 in which powder moves and an air movement path 322 in which air moves may be separately formed in the path forming part 320. For example, the powder movement path 321 may be formed in the shape of a hollow that passes through the path forming part 320 in a longitudinal direction, and the air movement path 322 may be formed due to an outer surface of the path forming part 320 being recessed in the longitudinal direction. Meanwhile, upper ends of the powder movement path 321 and the air movement path 322 may be configured to communicate with the movement hole 311 of the stem 310 so that the powder and air moving upward through the powder movement path 321 and the air movement path 322 may be discharged through the discharge hole 210.

A diameter or width of the air movement path 322 may be decreased at an upper portion of the air movement path 322 so that an air acceleration hole 322-1 is formed. As air passes through the air acceleration hole 322-1, the air speed increases and the air pressure decreases due to the Venturi effect, and since the air is injected into the movement hole 311 of the stem 310 and the discharge hole 210, an air pressure difference between the movement hole 311 and a powder inlet 610 increases. Accordingly, in the present invention, the powder stored in the container main body 100 may be suctioned to the powder movement path 321 and discharged through the discharge hole 210 along with the air.

The opening/closing member 400 may be installed at the upper portion of the stem 310 and open or close the movement hole 311. For example, the opening/closing member 400 may be configured to ascend and open the movement hole 311 when the button part 200 rotates in the first direction and to descend and close the movement hole 311 when the button part 200 rotates in the second direction. To this end, the opening/closing member 400 may include a first opening/closing part 410, a second opening/closing part 420, and the ascending protrusion 430.

The first opening/closing part 410 may open or close the movement hole 311 according to ascending and descending of the opening/closing member 400. For example, the first opening/closing part 410 may be configured to come in close contact with an inner circumferential surface of the stem 310 and close the movement hole 311 when the opening/closing member 400 is in a descended state and to be spaced apart from the inner circumferential surface of the stem 310 and open the movement hole 311 when the opening/closing member 400 is in an ascended state.

The second opening/closing part 420 may be disposed at an upper portion of the first opening/closing part 410 and ascend or descend in close contact with the inner circumferential surface at the upper portion of the stem 310. In this way, the second opening/closing part 420 may close an upper space inside the stem 310 that is disposed higher than the communication hole 312 and prevent the powder and air moving through the movement hole 311 from flowing out through the upper portion of the stem 310 instead of flowing out through the communication hole 312.

The ascending protrusion 430 may be provided as a pair of ascending protrusions 430 formed at both sides of an outer circumferential surface of an upper portion of the opening/closing member 400 and may allow the opening/closing member 400 to ascend and descend according to a direction in which the button part 200 rotates. Specifically, the ascending protrusion 430 may be inserted into the vertical guide groove 221 of the button part 200 and the spiral guide groove 313 of the stem 310 and move along the vertical guide groove 221 and the spiral guide groove 313 due to the rotation of the button part 200 in the first direction or the second direction opposite thereto. In this way, the ascending protrusion 430 may be configured to guide ascending and descending of the opening/closing member 400.

The compression chamber part 500 may be coupled to the outlet 110 so that at least a portion of the compression chamber part 500 is inserted into the container main body 100, and a lower portion of the movement part 300 may be inserted into an upper portion of the compression chamber part 500 and coupled thereto. The chamber 521 configured to store air therein may be formed inside the compression chamber part 500, and as the button part 200 is pressed, the compression chamber part 500 may inject the air inside the chamber 521 into the movement hole 311 through the air movement path 322. To this end, the compression chamber part 500 may include the upper housing 510, a lower housing 520, the piston 530, a nozzle part 540, a first check valve 550, and a second check valve 560.

The upper housing 510 is coupled to the upper portion of the container main body, and the stem 310 and the path forming part 320 may pass through the center of the upper housing 510 and be inserted into the upper housing 510. Here, the rotation preventing groove 514 into which the rotation preventing protrusion 314 of the stem 310 is inserted may be formed in an inner circumferential surface of the upper housing 510 so as to correspond to the number of rotation preventing protrusions 314 and the shape thereof.

Meanwhile, the guide groove 511 that forms a space to allow ascending and descending of the button part 200 and the descent preventing step 512 that prevents downward movement of the button part 200 may be disposed at both sides of an outer circumferential surface at an upper portion of the upper housing 510. Also, in an embodiment, a fixing protrusion 513 configured to fix the guide protrusion 230 of the button part 200 to prevent arbitrary rotation of the button part 200 in a state in which rotation of the button part 200 in the first direction or the second direction opposite thereto is completed may be disposed on the guide groove 511 and the descent preventing step 512.

Also, a spring support part 515 may be disposed at the upper portion of the upper housing 510 to support the spring S that provides an elastic force to the stem 310 to allow the button part 200 to be restored.

The lower housing 520 may be inserted into the container main body 100 and coupled to a lower portion of the upper housing 510 to form the chamber 521 configured to store air therein. Also, at a lower portion of the lower housing 520, an extension 523 into which the nozzle part 540 is inserted to ascend and descend may be formed to extend a predetermined length downward. Also, in the lower housing 520, at least one air inlet hole 522 that passes through an inner lower end surface of the lower housing 520 to allow the chamber 521 to communicate with the inside of the container main body 100 may be formed to be spaced apart from the extension 523. In addition, in a region of the inner lower end surface of the lower housing 520 that is between the extension 523 and the air inlet hole 522, a coupling groove (not denoted by a reference numeral) to which the second check valve 560 is coupled may be formed to be recessed.

The piston 530 is coupled to the lower portion of the stem 310 and ascends or descends to change an air pressure inside the chamber 521 and move the air inside the chamber 521 to the air movement path 322. Specifically, an accommodation hole 531 may be formed to pass through a central portion of the piston 530, and the stem 310 may be inserted into the accommodation hole 531 and coupled to the piston 530. When the user presses the button part 200 or releases the pressure on the button part 200, an outer circumferential surface of the piston 530 may come in close contact with an inner side surface of the lower housing 520 and ascend or descend along with the stem 310 to change the air pressure inside the chamber 521. For example, when the button part 200 is pressed and the piston 530 descends, the air pressure inside the chamber 521 may be increased, and the air inside the chamber 521 may be injected into the movement hole 311 and the discharge hole 210 through the air movement path 322, and when the pressure on the button part 200 is released and the piston 530 ascends, the air flowing into the container main body 100 from the outside through the powder movement path 321 may pass through the air inlet hole 522 and fill the chamber 521.

The nozzle part 540 is disposed inside the lower housing 520, and since an upper end of the nozzle part 540 passes through the piston 530 through the accommodation hole 531 and is connected to a lower portion of the path forming part 320, the nozzle part 540 may allow the powder movement path 321 to communicate with the inside of the container main body 100. Here, a lower end of the nozzle part 540 may be inserted into the extension 523 of the lower housing 520 and configured to ascend and descend along with the stem 310 according to whether the button part 200 is pressed.

In an embodiment, when the nozzle part 540 passes through the piston 530, an inner circumferential surface of the accommodation hole 531 of the piston 530 and an outer circumferential surface of the nozzle part 540 may be configured to be spaced apart so as not be come in contact with each other. In this case, when the piston 530 descends, the compressed air inside the chamber 521 may be delivered to the air movement path 322 through a separation space between the inner circumferential surface of the accommodation hole 531 and the nozzle part 540.

The first check valve 550 may be coupled to an inner side of the accommodation hole 531 to surround the outer circumferential surface of the nozzle part 540 and may regulate the movement of air from the air movement path 322 to the chamber 521 through the separation space. The first check valve 550 may include a first sealing part 551 and a first coupling part 552.

The first sealing part 551 may be formed to extend from the first coupling part 552 toward the nozzle part 540 and may, according to ascending and descending of the piston 530, come in close contact with the outer circumferential surface of the nozzle part 540, be spaced apart therefrom and prevent air from flowing into the chamber 521 from the air movement path 322, or allow the air inside the chamber 521 to move to the air movement path 322. To this end, at least a region of the first sealing part 551 may be made of a soft material such as silicone, but the present invention is not limited thereto. Also, in an embodiment, at least a portion of the first sealing part 551 may be formed to be inclined upward toward the air movement path 322 to facilitate the opening/closing operation.

The first coupling part 552 may be formed in the shape of, for example, an annular edge at an outer circumference of a lower end portion of the first sealing part 551 and may be coupled to the inner side of the accommodation hole 531. In order to allow coupling of the first coupling part 552, a stepped part (not denoted by a reference numeral) which protrudes inward from the inner circumferential surface of the accommodation hole 531 may be formed in the piston 530. That is, in a state in which the first coupling part 552 is seated on the stepped part, the first coupling part 552 may be pressed by the lower portion of the stem 310 inserted into the accommodation hole 531. In this way, the first coupling part 552 may be implemented to be coupled to the inner side of the accommodation hole 531.

The second check valve 560 may be coupled to the inner lower end surface of the lower housing 520 and regulate air moving (or flowing out) from the chamber 521 into the container main body 100. The second check valve 560 may include a second sealing part 561 and a second coupling part 562.

The second sealing part 561 may be formed to extend outward from an upper end portion of the second coupling part 562 so as to be perpendicular thereto and may come in close contact with a portion of the inner lower end surface of the lower housing 520, in which the air inlet hole 522 is formed, or be spaced apart therefrom to open or close the air inlet hole 522. To this end, at least a region of the second sealing part 561 may be made of a soft material such as silicone, but the present invention is not limited thereto.

The second coupling part 562 may be formed in, for example, an annular shape with a hollow center at one end inside the second sealing part 561 and may be inserted into a coupling groove (not denoted by a reference numeral) formed in the inner lower end surface of the lower housing 520 and coupled thereto.

The tube 600 may have one end coupled to the extension 523 of the lower housing 520 and the other end extending to a predetermined position from a lower end surface of the container main body 100 and may allow the nozzle part 540 to communicate with the inside of the container main body 100. Accordingly, the powder inside the container main body 100 may move to the movement hole 311 via the tube 600, the nozzle part 540, and the powder movement path 321.

Meanwhile, at least a portion of an outer circumferential surface of the other end of the tube 600 may be cut out upward so that the powder inlet 610 is formed. The powder inside the container main body 100 may more easily enter the tube 600 through the powder inlet 610.

The screw cap 700 is screw-coupled to the upper portion of the container main body 100 (particularly, an outer circumferential surface of the outlet 110) and may press the circumference of the upper housing 510 and/or the lower housing 520 to allow the compression chamber part 500 to be coupled to the container main body 100.

The shoulder part 800 is coupled to an outer side of the screw cap 700 to surround the screw cap 700, and the over-cap 900 may be coupled to an upper portion of the shoulder part 800 to prevent powder from being discharged when the button part 200 is pressed due to carelessness of the user.

Meanwhile, in an embodiment, a fine protrusion part (not denoted by a reference numeral) configured to provide a frictional force during the coupling or separation of the shoulder part 800 and the screw cap 700 may be formed on at least one region of an inner circumferential surface of the shoulder part 800 and an outer circumferential surface of the screw cap 700 that correspond to each other.

However, the configurations of the powder discharging container illustrated in FIGS. 1 to 7 are illustrative, and the present invention is not limited thereto. The powder discharging container may be implemented in various other modified forms according to embodiments to which the present invention is applied.

Figure 8:
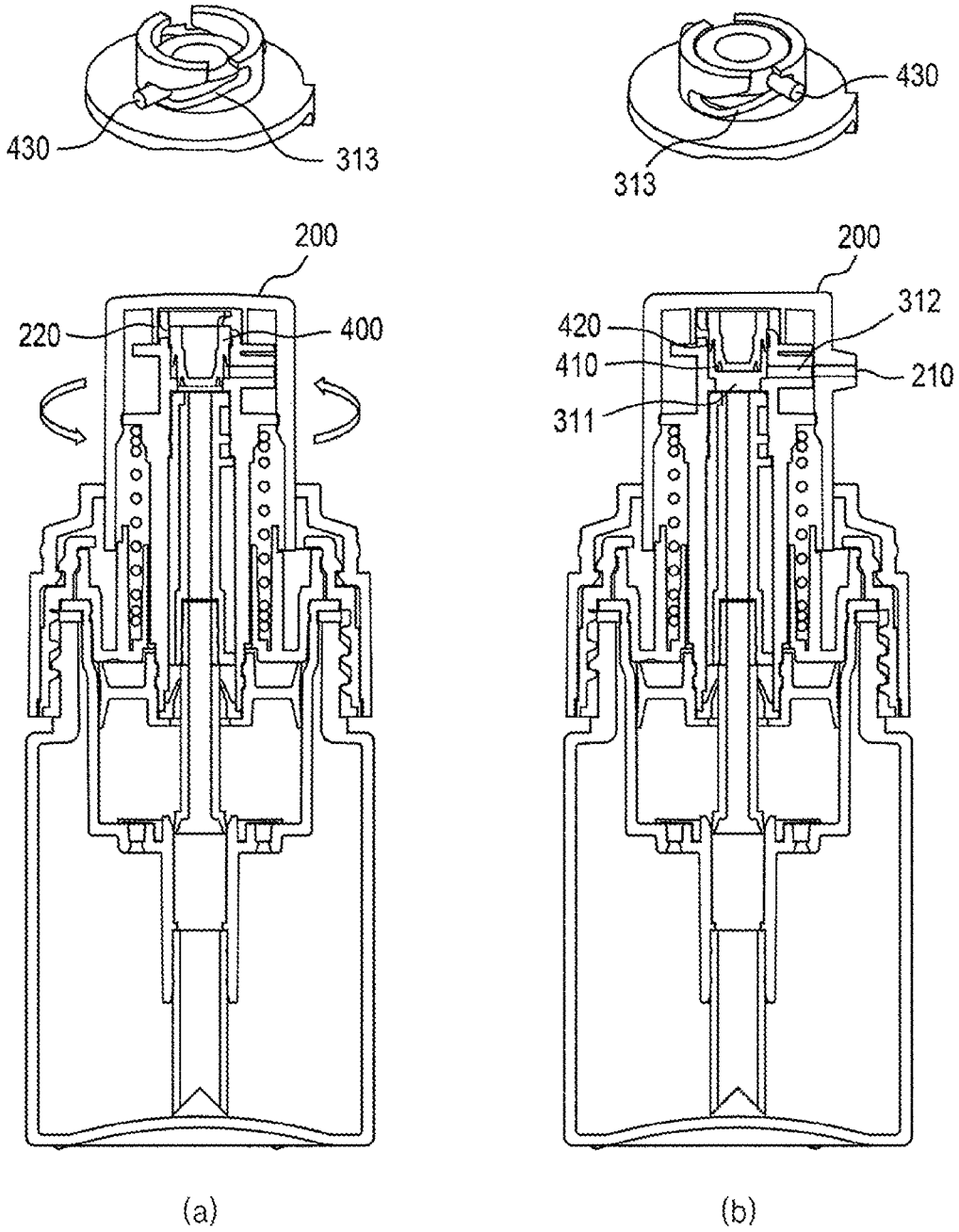
FIG. 8 illustrates an exemplary operation of the powder discharging container according to an embodiment of the present invention.

FIG. 8 illustrates an exemplary operation of the powder discharging container according to an embodiment of the present invention.

Referring to FIG. 8, when the button part 200 is rotated in the first direction while the opening/closing member 400 is in the descended state, the ascending protrusion 430 of the opening/closing member 400 ascends along the vertical guide groove 221 and the spiral guide groove 313 so that the opening/closing member 400 ascends. Thus, the first opening/closing part 410 of the opening/closing member 400 that is in close contact with the inner circumferential surface of the stem 310 is spaced apart therefrom and opens the movement hole 311.

Here, the discharge hole 210 of the button part 200 is aligned with the communication hole 312 of the stem 310, and the open movement hole 311 communicates with the discharge hole 210. Further, as described above, the guide protrusion 230 of the button part 200 moves to above the guide groove 511 from the descent preventing step 512, and thus the powder of the container main body 100 may be discharged to the outside as the user presses the button part 200.

Figure 9A:
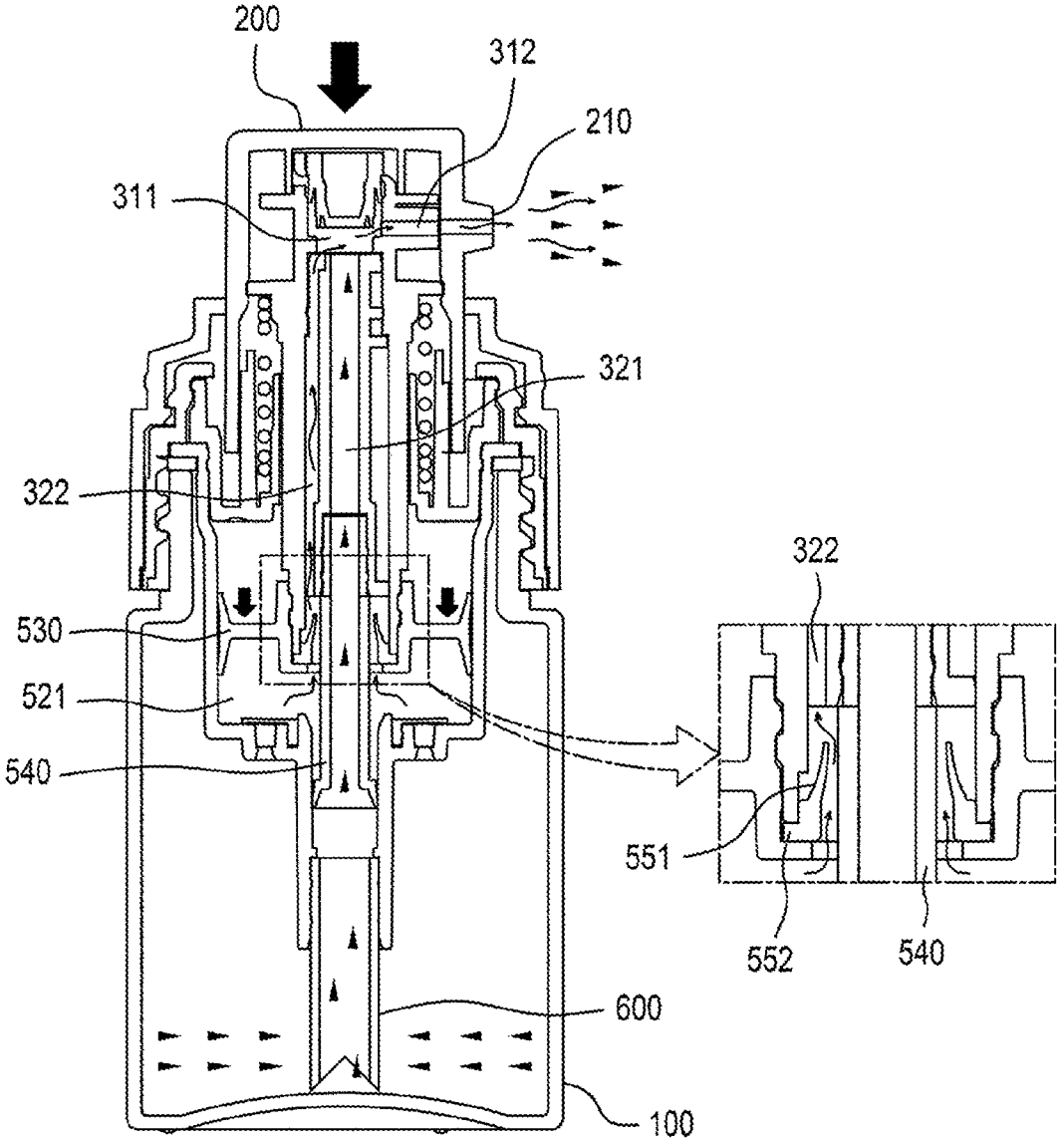
FIGS. 9A and 9B illustrate exemplary operations of the powder discharging container according to an embodiment of the present invention.
Figure 9B:
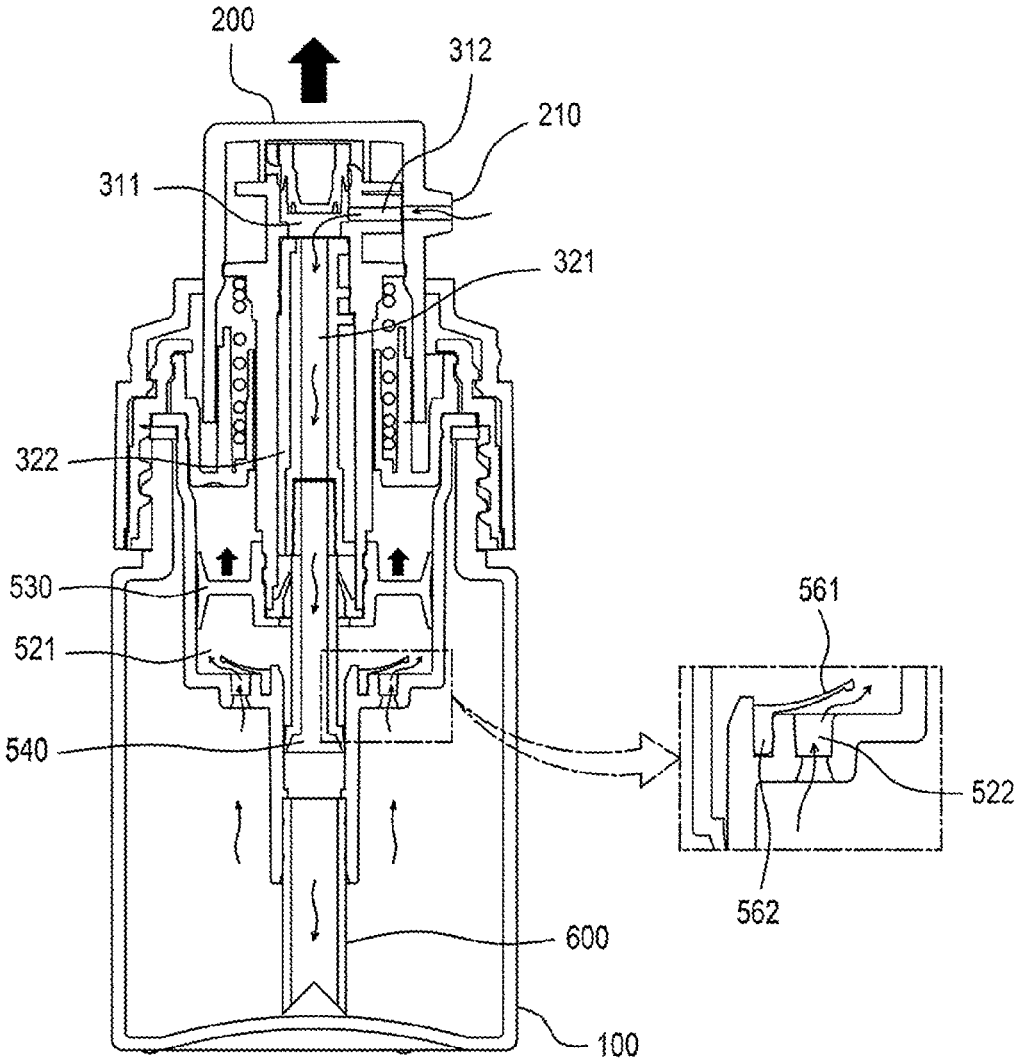

FIGS. 9A and 9B illustrate exemplary operations of the powder discharging container according to an embodiment of the present invention.

First, referring to FIG. 9A, when the user presses the button part 200 in the state (b) illustrated in FIG. 8, the piston 530 descends along with the stem 310, and the air pressure inside the chamber 521 is increased. Accordingly, since the first sealing part 551 of the first check valve 550 that is in close contact with the outer circumferential surface of the nozzle part 540 and blocks air is spaced apart from the outer surface of the nozzle part 540 due to the air pressure, the chamber 521 and the air movement path 322 communicate, the air speed increases as a fixed amount of air stored in the chamber 521 passes through the air movement path 322, and the air is injected into the movement hole 311 and the discharge hole 210 while the pressure of the air is low.

Accordingly, since the air pressure difference between the movement hole 311 and the powder inlet 610 increases, the powder stored inside the container main body 100 is suctioned into the tube 600, moved to the movement hole 311 via the nozzle part 540 and the powder movement path 321, and discharged to the outside through the discharge hole 210 along with air. Here, the second sealing part 561 of the second check valve 560 comes in close contact with the inner lower end surface of the lower housing 520 and keeps the air inlet hole 522 sealed so as to prevent the air inside the chamber 521 from moving into the container main body 100.

Referring to FIG. 9B, when the user releases the pressure on the button part 200, since the button part 200 is restored to its original position due to the elastic force of the spring S, the piston 530 ascends and the air pressure inside the chamber 521 becomes lower than the air pressure inside the container main body 100. Thus, the first sealing part 551 of the first check valve 550 is restored to come in close contact with the outer surface of the nozzle part 540, while the second sealing part 561 of the second check valve 560 is spaced apart upward from the inner lower end surface of the lower housing 520 and opens the air inlet hole 522. Accordingly, outside air is suctioned into the container main body 100 via the powder movement path 321, the nozzle part 540, and the tube 600, and the air flows into the chamber 521 through the air inlet hole 522 so that the air inside the chamber 521 is replenished. When the piston 530 ascends and is completely restored to its original position, the second sealing part 561 of the second check valve 560 comes in contact with the inner lower end surface of the lower housing 520 again and seals the air inlet hole 522.

Exemplary embodiments have been disclosed herein and in the drawings. Although specific terms have been used herein, the terms are only used for the purpose of describing the present invention and are not intended to limit meanings or limit the scope of the present invention described in the claims below. Therefore, those of ordinary skill in the art should understand that various modifications and other equivalent embodiments are possible. Accordingly, the actual technical scope of the present invention should be defined by the technical idea of the attached claims.

The invention claimed is:

1. A powder discharging container comprising:

a container main body configured to store powder;

a button part disposed at an upper side of the container main body, configured to be pressed by a user, and having a discharge hole formed at one side thereof;

a stem configured to ascend or descend according to whether the button part is pressed and having a movement hole formed inside an upper portion thereof to communicate with the discharge hole;

a path forming part disposed inside the stem, communicating with an inside of the container main body, and having a powder movement path in which the powder moves and an air movement path in which air moves formed therein; and a compression chamber part coupled to a lower portion of the stem and a lower portion of the path forming part, and having a chamber formed therein to store air, and is configured to, as the button part is pressed, inject the air inside the chamber into the movement hole through the air movement path, wherein, as the air is injected from the chamber into the movement hole due to the button part being pressed, the powder inside the container main body moves through the powder movement path and the movement hole and is discharged to an outside through the discharge hole.

2. The powder discharging container of claim 1, wherein the compression chamber part comprises:

an upper housing coupled to an upper portion of the container main body, wherein the stem and the path forming part are inserted into the upper housing;

a lower housing coupled to a lower portion of the upper housing and forming the chamber in which the air is stored;

a piston coupled to the lower portion of the stem and, according to whether the button part is pressed, ascends or descends in close contact with an inner side surface of the lower housing to change a pressure of the air inside the chamber and move the air inside the chamber to the air movement path; and a nozzle part disposed inside the lower housing and passing through the piston to be coupled to the lower portion of the path forming part, and configured to allow the powder movement path to communicate with the inside of the container main body.

3. The powder discharging container of claim 2, wherein:

an accommodation hole is formed to pass through the piston and the lower portion of the stem is inserted thereinto;

the nozzle part passes through the piston via the accommodation hole and is coupled to the lower portion of the path forming part; and the air inside the chamber moves to the air movement path through a separation space between an inner circumferential surface of the accommodation hole and the nozzle part.

4. The powder discharging container of claim 3, wherein the compression chamber part further comprises a first check valve coupled to an inner side of the accommodation hole and configured to regulate an inflow of air from the air movement path to the chamber through the separation space.

5. The powder discharging container of claim 4, wherein:

the first check valve comprises:

a first coupling part coupled to the inner side of the accommodation hole; and a first sealing part extending from the first coupling part toward an outer circumferential surface of the nozzle part; and the first sealing part comes in close contact with the outer circumferential surface of the nozzle part and blocks the inflow of air from the air movement path to the chamber, but when the piston descends, the first sealing part is spaced apart from the outer circumferential surface of the nozzle part due to an air pressure and allows the chamber and the air movement path to communicate.

6. The powder discharging container of claim 5, wherein at least a portion of the first sealing part is formed to be inclined upward toward the air movement path.

7. The powder discharging container of claim 5, wherein:

a stepped part protruding toward the inner side of the accommodation hole is formed at the piston; and the first coupling part of the first check valve is disposed on the stepped part and pressed by the lower portion of the stem that is inserted into the accommodation hole.

8. The powder discharging container of claim 2, wherein:

at least one air inlet hole configured to allow the chamber to communicate with the inside of the container main body is formed in an inner lower end surface of the lower housing; and the compression chamber part further comprises a second check valve configured to regulate movement of the air from the chamber into the container main body through the at least one air inlet hole.

9. The powder discharging container of claim 8, wherein:

the second check valve comprises:

a second coupling part coupled to the inner lower end surface of the lower housing; and a second sealing part extending outward from one end of the second coupling part; and the second sealing part comes in close contact with the inner lower end surface of the lower housing in which the at least one air inlet hole is formed and blocks the movement of the air from the chamber into the container main body through the at least one air inlet hole, but when the piston ascends, the second sealing part is spaced apart from the inner lower end surface of the lower housing due to a pressure of air flowing into the container main body through the powder movement path and allows the chamber to communicate with the inside of the container main body.

10. The powder discharging container of claim 2, wherein an extension extending a predetermined length downward is formed at a lower portion of the lower housing, wherein the nozzle part ascends or descends in the extension according to whether the button part is pressed.

11. The powder discharging container of claim 10, further comprising a tube having one end thereof coupled to the extension and an other end thereof extending from a lower end surface of the container main body to a predetermined position and the tube is configured to allow the nozzle part to communicate with the inside of the container main body, wherein at least a portion of an outer circumferential surface of the other end of the tube is cut out upward and forms a powder inlet.

* * * * *